US006918498B2

(12) United States Patent
Sparkowski

(10) Patent No.: US 6,918,498 B2
(45) Date of Patent: Jul. 19, 2005

(54) METHOD AND APPARATUS FOR A WIRE SHELF HOOKING ONTO SLOTTED BRACKETS

(75) Inventor: Robert P. Sparkowski, Schaumburg, IL (US)

(73) Assignee: Chicago Display Marketing Corporation, Melrose Park, IL (US)

( * ) Notice: Subject to any disclaimer, the term of this patent is extended or adjusted under 35 U.S.C. 154(b) by 0 days.

(21) Appl. No.: 10/430,561

(22) Filed: May 6, 2003

(65) Prior Publication Data

US 2004/0222178 A1 Nov. 11, 2004

(51) Int. Cl.[7] ..... A47F 5/14

(52) U.S. Cl. ..... 211/187; 211/181.1; 108/108

(58) Field of Search ..... 211/87.01, 208, 211/187, 90.03, 103, 90.04, 106, 90.01, 181.1, 134, 192, 59.2; 248/248, 218.4, 220.21, 224.61, 222.51, 222.52, 225.11; 108/107, 108, 147.11; D6/566, 574, 570

(56) References Cited

U.S. PATENT DOCUMENTS

| | | | | | |
|---|---|---|---|---|---|
| 2,316,892 | A | | 4/1943 | Saul, Jr. | |
| 2,579,704 | A | | 12/1951 | Saul, Jr. | |
| 3,186,527 | A | * | 6/1965 | Konstant et al. | 403/376 |
| 3,294,351 | A | | 12/1966 | Rollins, Jr. | |
| 3,311,072 | A | | 3/1967 | Pattison | |
| 3,575,484 | A | | 4/1971 | Kesling | |
| 3,730,467 | A | | 5/1973 | Dutchburn | |
| 3,993,002 | A | | 11/1976 | Stroh | |
| 4,086,858 | A | | 5/1978 | Howitt | |
| 4,109,797 | A | | 8/1978 | Brunette | |
| 4,122,955 | A | | 10/1978 | Celms | |
| 4,444,323 | A | | 4/1984 | Travis | |
| 4,492,169 | A | | 1/1985 | Ware et al. | |
| 4,624,376 | A | * | 11/1986 | Bertram | 211/187 |
| D289,353 | S | | 4/1987 | Davis et al. | |
| 4,996,929 | A | * | 3/1991 | Saal | 108/107 |
| 5,062,605 | A | | 11/1991 | Muhlethaler | |
| 5,072,839 | A | * | 12/1991 | Arnone | 211/187 |
| 5,326,062 | A | * | 7/1994 | Remmers | 248/250 |
| 5,351,842 | A | * | 10/1994 | Remmers | 211/90.03 |
| 5,397,087 | A | * | 3/1995 | Teece | 248/220.42 |
| 5,480,039 | A | | 1/1996 | Merl | |
| 5,482,168 | A | | 1/1996 | Welch et al. | |
| 5,601,038 | A | * | 2/1997 | Welch et al. | 108/193 |
| 5,641,083 | A | | 6/1997 | Metcalf | |
| 5,806,820 | A | * | 9/1998 | Simon | 248/243 |
| 5,868,263 | A | | 2/1999 | McAllister et al. | |
| 5,899,041 | A | * | 5/1999 | Durin | 52/660 |
| 6,386,096 | B1 | * | 5/2002 | Tiemann | 99/426 |
| 6,726,035 | B2 | * | 4/2004 | Zadak | 211/90.03 |
| 2004/0007549 | A1 | * | 1/2004 | Klein et al. | 211/118 |
| 2004/0011752 | A1 | * | 1/2004 | Zadak | 211/90.03 |

* cited by examiner

*Primary Examiner*—Jennifer E. Novosad
(74) *Attorney, Agent, or Firm*—Vedder Price Kaufman & Kammholz

(57) ABSTRACT

A rack system including a support having multiple longitudinally spaced slots for connecting at least one generally Z-shaped shelf, or any suitable shape. The shelf has a front leg and a back leg interconnected by a support position. The front leg may, for example, provide an upstanding lip. The support portion may be referred to as a median support portion between the front leg and the back leg of the generally Z-shaped shelf. The back leg includes a first transverse element disposed adjacent to the support position, and a second transverse element disposed at a distal end of the back leg, such that the first and second transverse elements engaged adjacent slots in order to connect the shelves to the support. The shelf may be connected to the support having the plurality of longitudinally spaced slots by inserting the generally Z-shaped shelf in order to connect the shelf to the support.

17 Claims, 8 Drawing Sheets

METHOD AND APPARATUS FOR A WIRE SHELF HOOKING ONTO SLOTTED BRACKETS

FIELD OF THE INVENTION

The invention relates generally to a rack and, more particularly, to a rack having wire shelves.

BACKGROUND OF THE INVENTION

Some rack configurations require the use of an intermediate bracket connected to a wall-mounted support member for supporting a shelf. These intermediate brackets have a vertical front wall with a front face and two side walls each having an inside face. A cantilever arm connects to, and projects generally perpendicular from, the front face and generally away from the two side walls of the intermediate bracket. The wall-mounted support member has a front wall, two parallel side walls generally perpendicular to the front wall and two outer flanges extending from the side walls and generally parallel to the front wall. A connecting assembly permits the intermediate bracket to be connected to the support member. One disadvantage of this rack configuration is that it requires an intermediate bracket to connect the wall-mounted support member to the shelf. As a result, this rack configuration does not connect the shelf directly to the wall-mounted support column members.

Other racks provide for a wall-mounted storage system, including at least one pair of slotted-apart vertical hanger bars for attachment to a wall and at least one removable shelf support bracket associated with each hanger bar. A shelf is supported by the brackets and is releasably attached thereto by rear hooks on the brackets that hook over the rear rail of the shelf. The shelf support bracket is associated with each vertical hanger bar. One disadvantage of this rack configuration is that the vertical hanger bars require an intermediate bracket and therefore does not connect the shelf directly to the vertical hangar bars.

Thus, it would be desirable for a rack to connect directly to a wall bracket in an efficient, reliable and cost-effective manner.

BRIEF DESCRIPTION OF THE DRAWINGS

The present invention is illustrated by way of example and not limitation in the accompanying figures, in which like reference numerals indicate similar elements, and in which.

DETAILED DESCRIPTION

A rack system including a support having multiple longitudinally spaced slots for connecting at least one generally Z-shaped shelf. The shelf generally has a Z-shape, for example, from a side view. The generally Z-shaped shelf may be composed of, for example, wire or any tubular shaped material constructed from any suitable materials, such as metal, plastic or wood. Additionally, the wire shelf may take on any suitable shape conforming to a generally Z-shaped side view. The shelf has a front leg and a back leg interconnected by a support position. The front leg may, for example, be configured as an upstanding lip having a tubular or flat shape, constructed from wire or sheet metal. The support portion may be a median support portion between the front leg and the back leg of the generally Z-shaped self. The back leg includes a first transverse element disposed adjacent to the support position and a second transverse element disposed at a distal end of the back leg, such that the first and second transverse elements engage adjacent slots in order to connect the shelves to the support. For example, the rear leg of each shelf may have a pair of spaced transversely extending rods.

The shelf may be connected to the support having the plurality of longitudinally spaced slots, by inserting the generally Z-shaped shelf into the support. The transverse elements directly engage the longitudinally spaced slots in the support. Such a rack system does not require an intermediate bracket for connecting the shelf to the wall brackets, unlike conventional rack systems.

Figure 1:
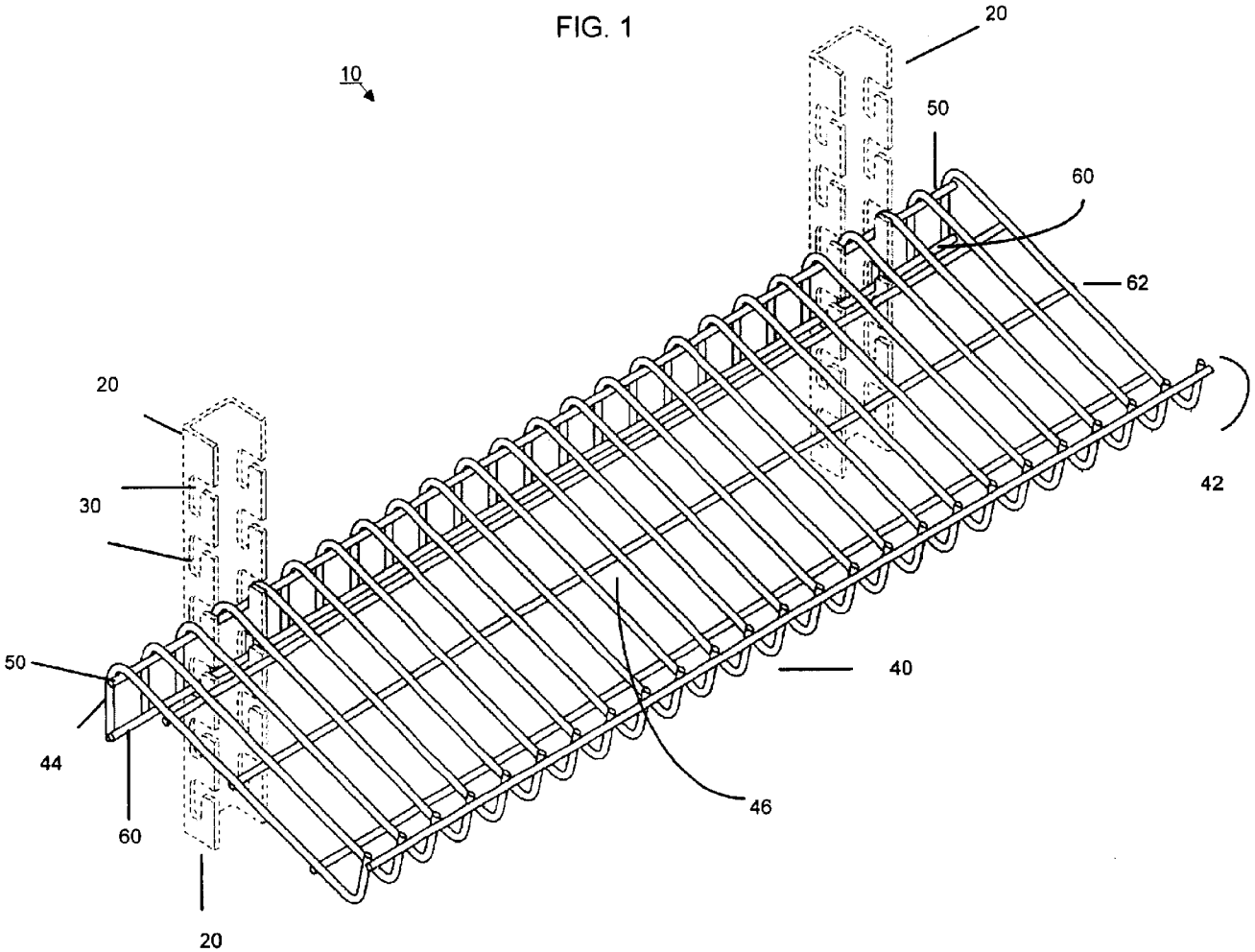
FIG. 1 illustrates a wire shelf hooking onto slotted brackets according to one embodiment of the present invention.

FIG. 1 illustrates a rack system 10 including a wire shelf 40 hooking onto slotted supports 20, such as vertical brackets, according to one embodiment of the present invention. The rack system 10 includes a support 20 having a plurality of longitudinally spaced slots 30 and at least one generally Z-shaped shelf 40 having a front leg 42 and a back leg 44 interconnected by a support portion 46. The support portion 46 may be located at a median location between the front leg 42 and the back leg 44 of the generally Z-shaped shelf 40. The back leg 44 includes a first transverse element 50 disposed adjacent the support portion 46 and a second transverse element 60 disposed at a distal end of the back leg 44 such that the first transverse element 50 and the second transverse element 60 engage adjacent slots of the support 20 in order to connect the shelf 40 to the support 20. A least one shelf 40 is connected to the support 20 by inserting the generally Z-shaped shelf 40 into adjacent slots of the support 20. The front leg 42 of the shelf 40 is configured as, according to one embodiment, an upstanding lip, to maintain a product in position.

Figure 2:
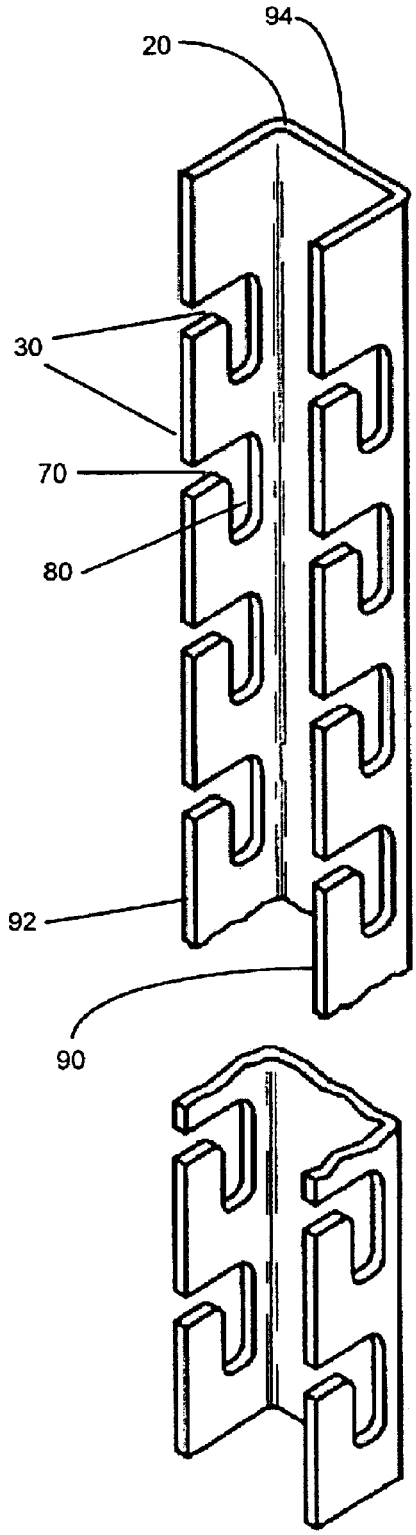
FIG. 2 illustrates a vertical bracket according to one embodiment of the present invention.

As shown in FIG. 2, the support 20 includes at least one bracket, such as a vertically oriented bracket. The multiple longitudinally spaced slots 30 each have an upper entry portion 70 and a lower retainer portion 80 formed in each bracket 20. Accordingly, each vertically oriented bracket 20 has multiple vertically spaced slots 30, with each slot 30 having an upper horizontal entry portion 70 and a lower vertical retainer portion 80. According to the embodiment shown in FIG. 2, the support 20 is configured as a substantially U-shaped bracket including an inner arm 92 and an outer arm 90 connected by a spine element 94 such that the multiple longitudinally spaced slots 30 are formed in the outer arms 90 and inner arms 92 aligned in lateral opposition. As shown in FIG. 1, first and second transverse elements 50, 60 engage the slots 30 in the inner arm 92 and outer arm 90 of support 20.

Figure 3:
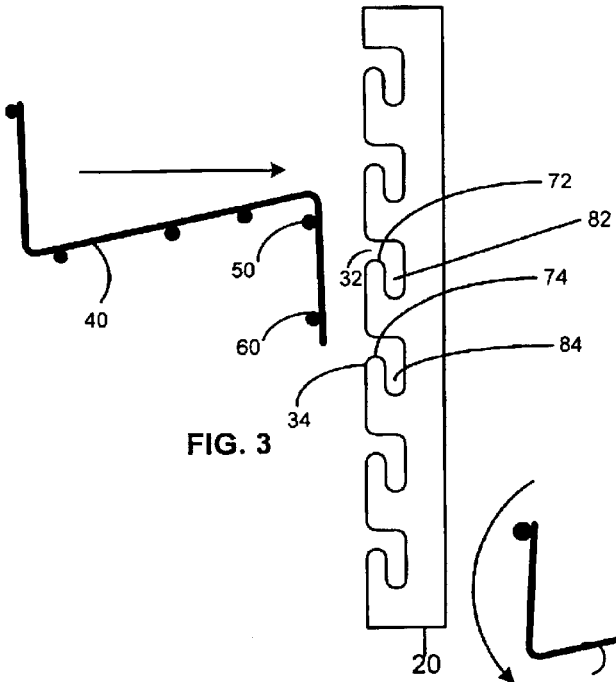
FIG. 3 illustrates a generally Z-shaped shelf detached from a support according to one embodiment of the present invention.

FIG. 3 illustrates a side view of the generally Z-shaped shelf 40 detached from the support 20. According to one embodiment, the support 20 includes at least one bracket, such as a vertical bracket, and adjacent multiple longitudinally spaced slots 32, 34 each having a corresponding upper entry portion 72, 74 and a lower retainer portion 82, 84. In this exemplary embodiment first and second transverse elements 50, 60 engage adjacent slots 32, 34. However, according to an alternative embodiment, the first and second transverse elements 50, 60 may engage non-adjacent slots, or slots spaced apart by one or more slots.

Figure 4:
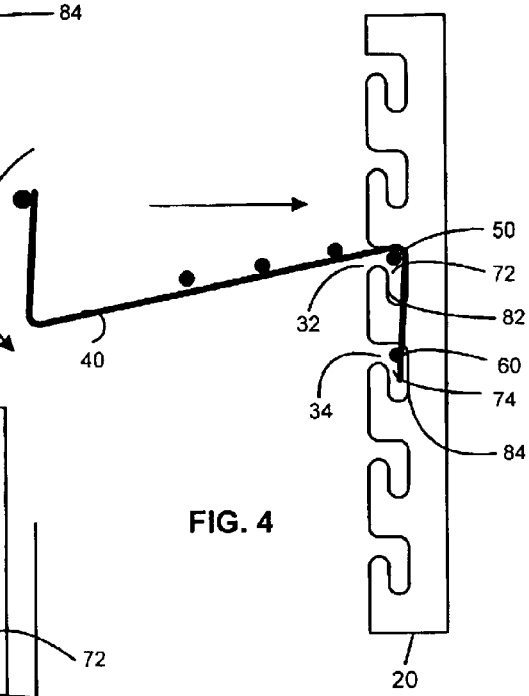
FIG. 4 illustrates the generally Z-shaped shelf inserted into the vertically spaced bracket.

FIG. 4 illustrates inserting the first 50 and second 60 transverse elements initially to engage adjacent upper entry portions 72, 74, respectively. According to this embodiment, the Z-shaped shelf 40 is initially inserted horizontally into adjacent upper entry portions 72, 74, respectively and is subsequently lowered into the lower retainer portions of the adjacent slots.

Figure 5:
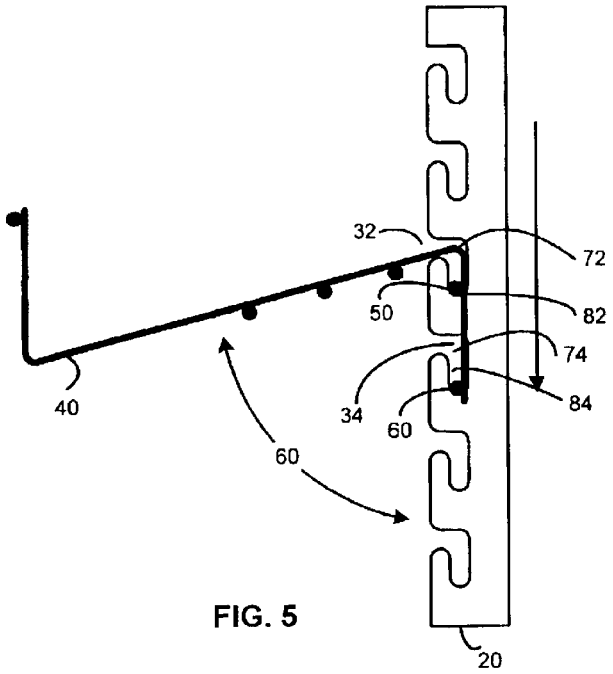
FIG. 5 illustrates a generally Z-shaped shelf inserted into the vertically spaced bracket according to one embodiment of the present invention.

FIG. 5 illustrates the position of the first 50 and second 60 transverse elements after they are placed in the upper entry portions 72, 74 and are then subsequently lowered into the lower retainer portions 82, 84 of the adjacent slots. Although the first and second transverse members 50, 60 are shown placed on the inside of the back leg 44, either first or second transverse members 50, 60 may be placed on the outside of the back leg 44, or on a combination of the front leg 42 and the back leg 44, to better accommodate loading of the bracket 20, and the application of a torque on shelf 40. The angle between the rear shelf leg 40 and bracket 20 is such that the shelf 40, as depicted in the drawings, has its median support position declining at an angle 60 with respect to the bracket 20.

Figure 6:
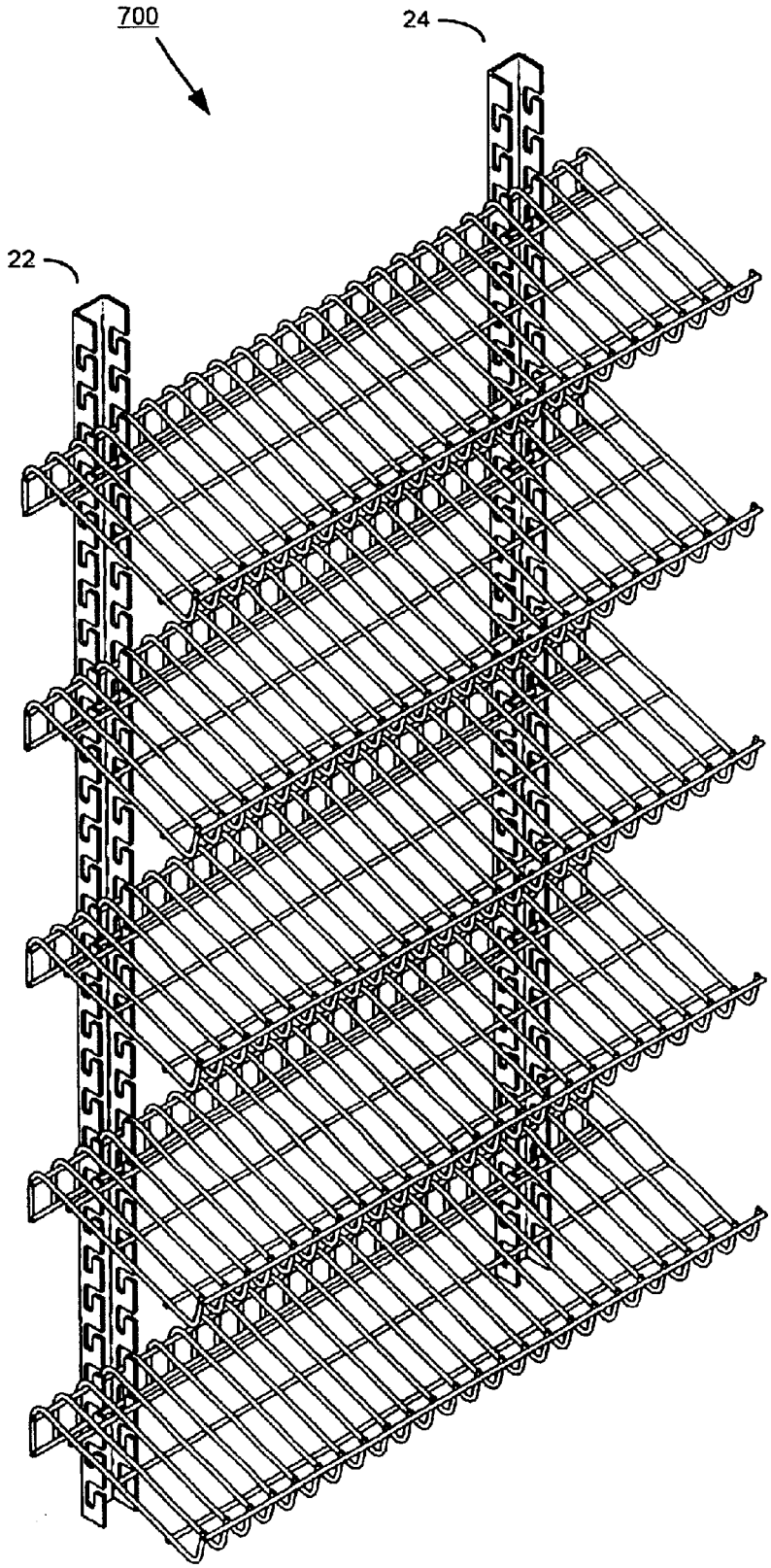
FIG. 6 illustrates a plurality of generally Z-shaped shelves coupled to a plurality of vertically spaced brackets according to one embodiment of the present invention.

FIG. 6 illustrates a rack 700 such that the support comprises two vertical brackets 22, 24 having multiple longitudinally spaced slots 30 and multiple shelves 40. As stated above, each slot 30 has an upper entry portion 72, 74 and a lower retainer portion 82, 84 in order to connect the first and second transverse elements 50, 60 of each shelf 40 to the support 20. Rack 700 illustrates first and second transverse elements 50, 60 engaged to vertical brackets 22, 24 where the first and second transverse elements 50, 60 are lowered into adjacent lower retainer portions 82, 84 for each bracket 22, 24, as previously discussed with respect to FIGS. 4 and 6. Although FIG. 6 illustrates five shelves 40 coupled to vertical brackets 22, 24, fewer or more shelves may be similarly attached.

The front leg 42 of the shelf 40 provides, according to one embodiment, an upstanding lip, to maintain a product in position. Accordingly, rack 700 may be used to provide shelf space for products in a retail establishment, such as a store or shop.

Rack 700 may be coupled to a wall via brackets 22, 24 through the use of conventional fasteners, such as screws, nails, nuts, bolts, hooks, or through the use of any suitable fastener. Alternatively, brackets 22, 24 may be supported from a stand on the floor or hung from above, for example, a ceiling support.

Figure 7:
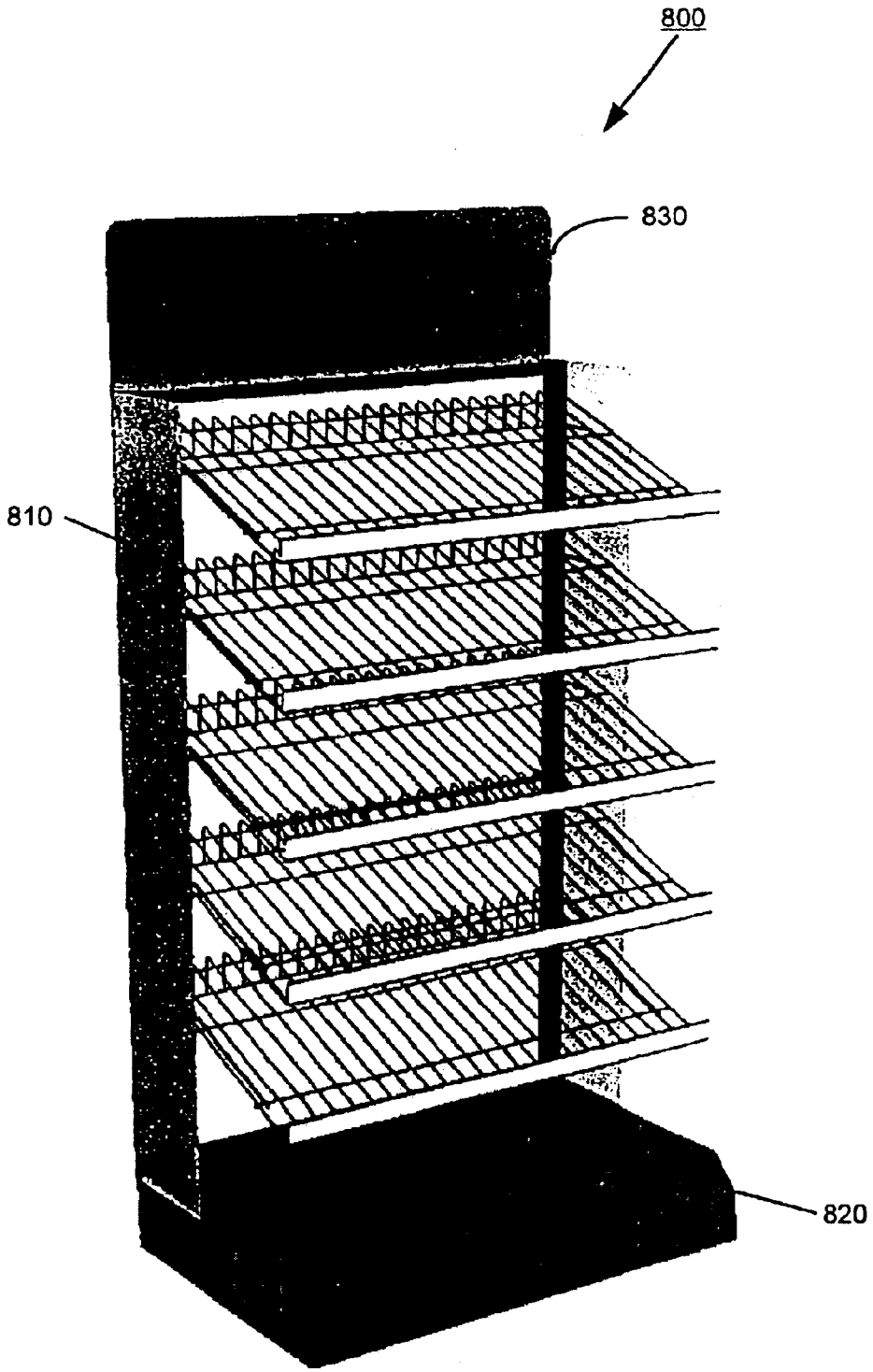
FIG. 7 illustrates a wire shelf system according to another embodiment of the present invention.

FIG. 7 illustrates, according to one alternative embodiment, a unitary frame 800 including at least one side wall 810, a base 820 coupled to each side wall 810, to support the unitary frame 800, and a header 830 coupled to the unitary frame 800 having defined an area for displaying indicia. For example, the header 830 may have an area for the advertisement of products or the display of other suitable information. The side wall 810, base 820, and header 830 may be made out of any suitable material such as sheet metal, wood, plastic, polyethylene, or any combination of other materials.

Figure 8:
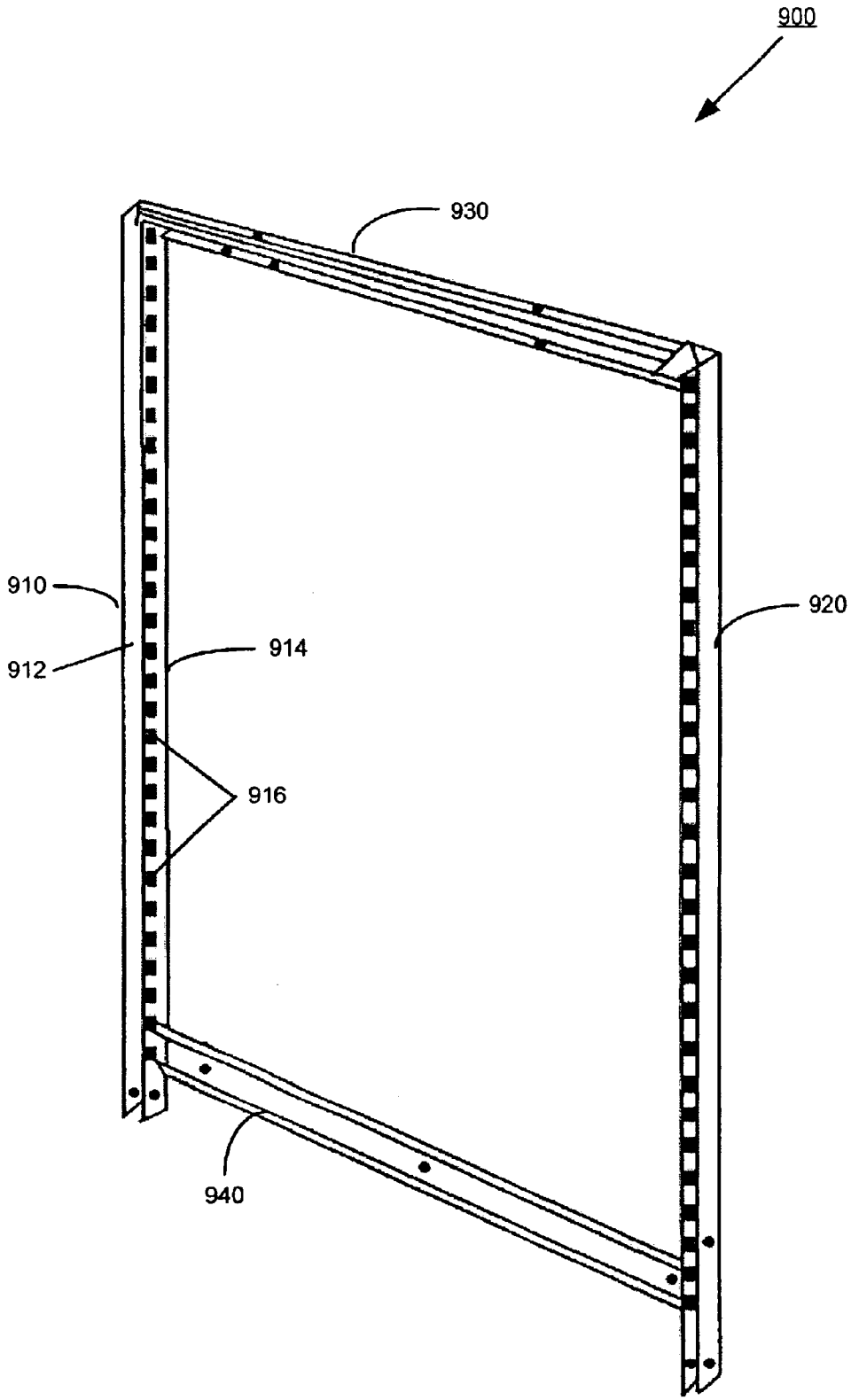
FIG. 8 illustrates a frame assembly according to one embodiment of the present invention.

FIG. 8 shows the unitary frame substructure 900 of the unitary frame 800 shown in FIG. 8. The unitary frame substructure 900 includes at least one side wall 910, 920, a header support 930, and a transverse base support 940. The at least one side wall 910, 920 is a substantially U-shaped channel including an outer flange 912 and an inner flange 914. The plurality of longitudinally spaced slots 916 are formed on the inner flange 914 for engaging the first and second transverse elements 50, 60 in order to connect the shelf 40 to the at least one side wall 910. According to one embodiment, support 810 of the unitary frame 800 includes two vertical side walls 910, 920 and a plurality of longitudinally spaced slots 916, each having an upper entry portion 920 and a lower entry portion 922.

FIG. 8 also illustrates the plurality of longitudinally spaced slots 916 on the inner flange 914. Inner flange 914 has an upper entry portion 922, and a lower retainer portion 924 such that each shelf 40 is connected to the inner flange 914 by inserting the first transverse member 50 and the second transverse member 60 into upper entry portions 920, respectively, of adjacent slots. The first and second transverse members 50, 60 are then lowered into the lower retainer portions 922 of the adjacent slots on inner flange 914. The shelves 40 of the unitary frame rack 800 may be engaged as discussed previously.

Figure 9:
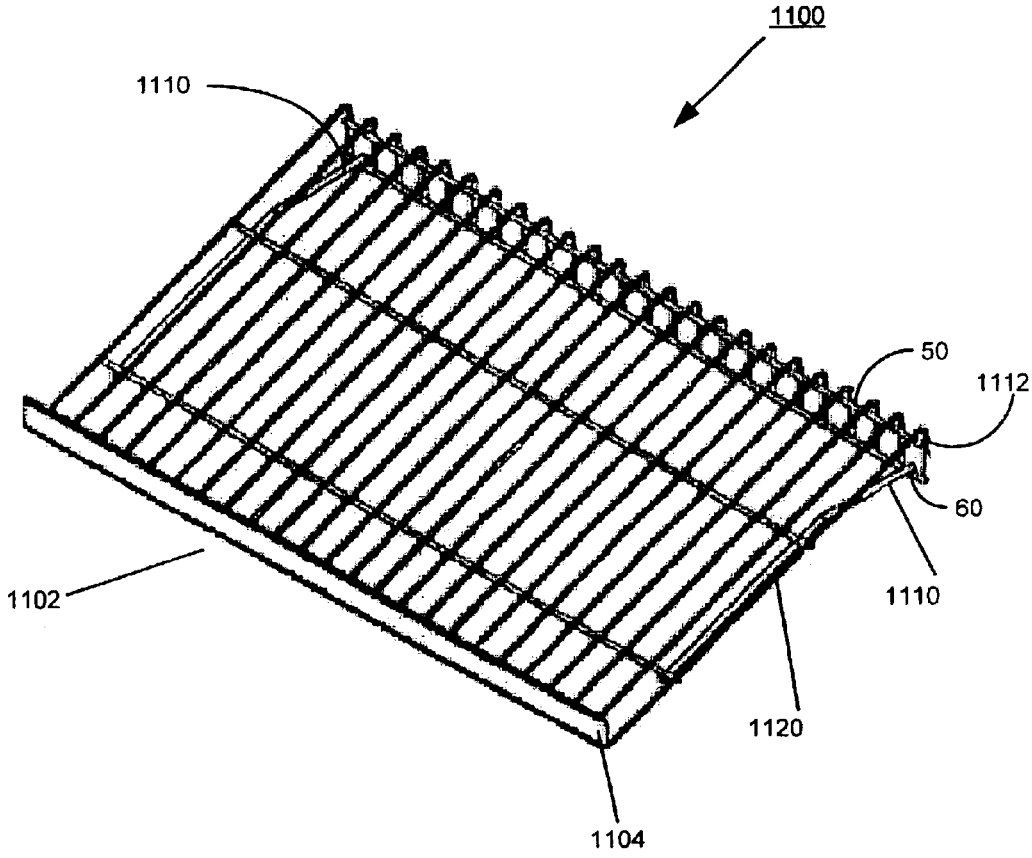
FIG. 9 illustrates a wire shelf according to another embodiment of the present invention.

FIG. 9 illustrates a shelf 1100 including a shelf sign 1102 connected to the front leg 1104 of the shelf 1100 wherein the shelf sign 1102 has a dimension approximately no larger than the front leg 1104 of the shelf. The shelf 1104 includes a median support element 1110 connected between the back leg 1112 of the shelf 1100 and the median support position 1120 of the generally Z-shaped shelf 1100. The angle between the median support position 1120 and the rear shelf leg 1112 is such that the shelf, as depicted in the drawings, has its median support position 1120 declining at an angle with respect to the supports 20.

The first transverse element 50 and second transverse element 60 of shelf 1100 are engaged, such as detachably coupled, to adjacent upper entry portions of the at least one vertical side wall 910. The first transverse element 50 and the second transverse element 60 are lowered into adjacent lower retainer portions of the at least one vertical side wall 910. The at least one side wall 910, 920 is a substantially U-shaped channel including an outer flange 912 and an inner flange 914 such that the plurality of longitudinally spaced slots 916 are formed on the inner flange 914 for engaging the first and second transverse elements 50, 60 in order to connect the shelf 1100 to the side wall, 910, 920. According to this embodiment, the width of the first and second transverse elements 50, 60 on shelf 1100 is less than the width between the outer flanges 912 of sidewalls 910, 920.

Figure 10:
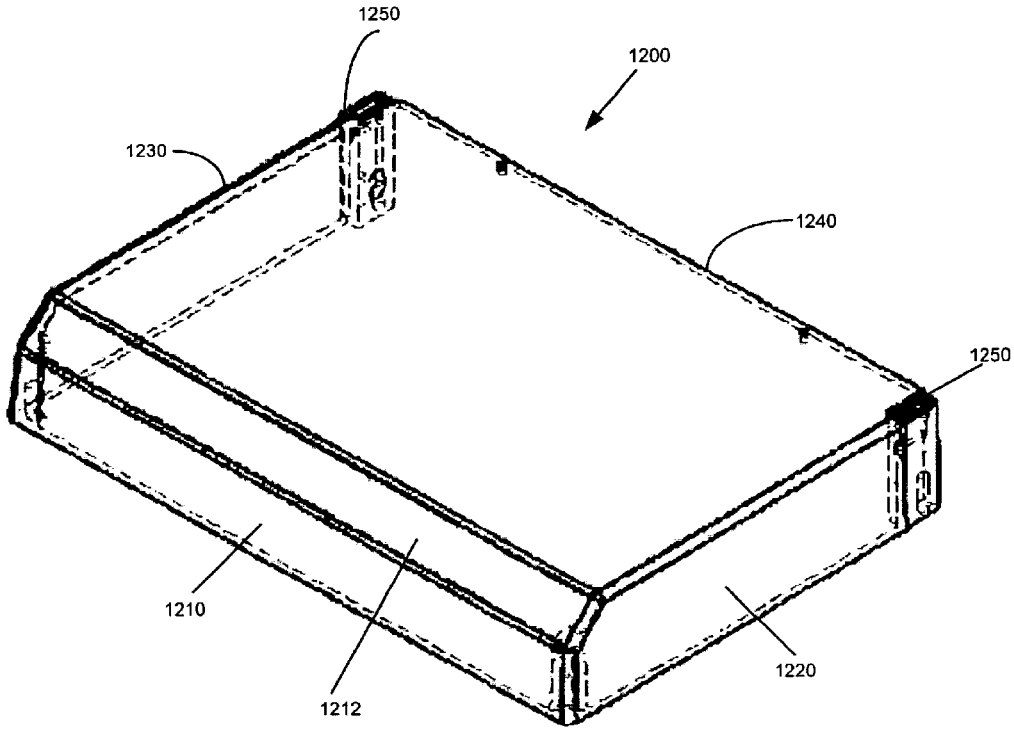
FIG. 10 illustrates a molded base according to one embodiment of the present invention.

The base 820 as shown in FIG. 7 is shown in FIG. 10 as a floor stand 1200 for coupling to the supports 20, such as the vertical brackets and side walls 910, 920. According to one embodiment, the floor stand 1200 has a front 1210, a beveled edge 1212, and sides 1220, 1230. According to this embodiment, back wall 1240 is empty, although a back wall 1240 may be placed on floor stand 1200 to cover the back side of floor stand 1200. The floor stand 1200 has supports 1250 to support the side walls 910 and 920. For example, if the side walls 910, 920 are U-shaped channels, then supports 1250 may also be U-channels in order to accept side walls 910, 920 and to secure the unitary subframe 900. According to one embodiment, wheels may be coupled to the floor stand via, for example, wheel sockets in order to permit the floor stand 1200 to roll on a floor surface. Alternatively, floor stand 1200 is rigidly attached to the floor via bolts, screws, velcro or with any other suitable fastener.

As such, the above-rack shelves 40, 1110 and supports 20, 910, 920 do not require an intermediate bracket for the shelf 40, 1110 to be connected to the supports 20, 910, 920. Accordingly, the racks, shelves and supports described provide an efficient, secure and cost-effective rack system. Although, for purposes of illustration, the racks, shelves, base, floor stand and supports were described as being constructed of wire, sheet metal, or other materials such as polyethylene may be used, or any other suitable material, such as aluminum, brass, iron, copper, magnesium, any type of plastic or composite material. For example, the unitary frame 800 shown in FIG. 7 may be formed from sheet metal.

As previously stated, the shelves 40 require no intermediate brackets for attaching to support 810. As a result, the shelves, such as wire shelves 40, may be economically and efficiently manufactured. In yet another embodiment, the unitary frame 800 may have a back panel. In yet another embodiment, the shelf 40, 1110 may have a powder coat applied, such as a plastic or rubber material, to improve durability and more securely provide support for products on the shelf 40. In yet another embodiment, the entire frame or unitary frame may have the powder coat applied. Other advantages will be recognized by those with ordinary skill in the art.

It should be understood that the implementation of other variations and modifications of the present invention and its various aspects will be apparent to those of ordinary skill in the art, and that the invention is not limited by the specific embodiments described. It is, therefore, contemplated to cover, the present invention, any and all modifications, variations or equivalents that fall within the spirit and scope of the basic underlying principles disclosed and displayed herein.

I claim:

1. A rack comprising:

a support having a plurality of longitudinally spaced slots; and at least one shelf generally having a Z-shape, the shelf having a front leg, a back leg interconnected by a support portion;

the back leg including:

a first transverse element disposed adjacent the support portion; and a second transverse element disposed at a distal end of the back leg, wherein the first and second transverse elements engage adjacent slots in order to connect the shelf to the support, and wherein the support is configured as at least one bracket, and the plurality of longitudinally spaced slots, each have an upper entry portion, and a lower retainer portion, each at least one bracket is substantially U-shaped including an inner and outer arm connected by a spine element such that the plurality of the longitudinally spaced slots are formed in the inner and outer arms aligned in lateral opposition.

2. The rack of claim 1, wherein the first and second transverse elements initially engage the upper entry portions of adjacent slots, and are subsequently lowered into the lower retainer portions of the adjacent slots.

3. The rack of claim 1, wherein the support is configured as two vertical brackets each having the plurality of longitudinally spaced slots formed therein, wherein each slot has an upper entry portion, and a lower retainer portion in order to connect the shelf to the support.

4. The rack of claim 1, wherein the front leg of the shelf is configured as an upstanding lip.

5. The rack of claim 1, wherein:

the first and second transverse elements initially engage the upper entry portions of adjacent slots, and are subsequently lowered into the lower retainer portions of the adjacent slots, the front leg of the shelf provides an upstanding lip, and the support is connected to a wall.

6. A rack comprising:

a support having a plurality of longitudinally spaced slots; and at least one shelf generally having a Z-shape, the shelf having a front leg, a back leg interconnected by a support portion;

the back leg including:

a first transverse element disposed adjacent the support portion; and a second transverse element disposed at a distal end of the back leg, wherein the first and second transverse elements engage adjacent slots in order to connect the shelf to the support, wherein the support is configured as a unitary frame comprising:

at least one side wall, a base connected to each at least one side wall; and a header connected to each at least one sidewall having an area for displaying indicia and;

the at least one side wail is substantially a U-shaped channel including an outer and an inner flange interconnected by a spine element such that the plurality of longitudinally spaced slots are formed on the inner flange for engaging the first and second transverse elements in order to connect the shelf to the side wall.

7. The rack of claim 6, wherein each longitudinally spaced slot on the inner flange has an upper entry portion and a lower retainer portion, such that each shelf is removably connected to the inner flange by engaging the first transverse member and the second transverse member initially into upper entry portions of adjacent slots, and subsequently lowering into lower retainer portions of the adjacent slots.

8. The rack of claim 7, including:

a shelf sign connected to the front leg of the shelf wherein the shelf sign has a dimension no larger than the front leg of the shelf; and a declining angle defined between the back leg of the shelf and the support portion of the generally Z-shaped shelf, wherein the generally Z-shaped shelf is removably connected to a plurality of vertical brackets.

9. The shelf system of claim 8, wherein the front leg of the generally Z-shaped shelf is configured as an upstanding lip, wherein a base includes a floor stand coupled to vertical brackets for supporting the vertical brackets.

10. The rack of claim 6, wherein the generally Z-shaped shelf is removably connected to a plurality of vertical brackets.

11. The rack of claim 6, including:

a shelf sign connected to the front leg of the shelf wherein the shelf sign has a dimension approximately no larger than the front leg of the shelf, and a declining angle defined between the back leg of the shelf and the support portion of the generally Z-shaped shelf.

12. The rack of claim 6, wherein each longitudinally spaced slot on an inner side wall has a lower entry portion and an upper retainer portion, such that each shelf is secured to the inner side wall by inserting the first transverse member and the second transverse member into lower entry portions of adjacent slots and are then raised into the upper retainer portions of the adjacent slots.

13. A method for connecting at least one shelf to a support having a plurality of longitudinally spaced slots comprising:

inserting the shelf into adjacent slots in order to connect the shelf to the support, the shelf having a generally Z-shape and a front leg, a back leg interconnected by a support portion, the back leg including a first transverse element disposed adjacent the support portion and a second transverse element disposed at a distal end of the back leg, and wherein the support is configured as a substantially U-shaped bracket including an inner and outer arm connected by a spine element such that the plurality of the longitudinally spaced slots are formed in the inner and outer arms aligned in lateral opposition, the method comprising:

engaging the first and second transverse elements with adjacent upper entry portions in the inner and outer arms; and lowering the first and second transverse elements into adjacent lower retainer portions in the inner and outer arms.

14. The method of claim 13 wherein the support is configured as at least one bracket, and the plurality of longitudinally spaced slots, each have an upper entry portion, and a lower retainer portion, the method comprising:

engaging the first and second transverse elements with adjacent upper entry portions; and lowering the first and second transverse elements into adjacent lower retainer portions.

15. The method of claim 13 wherein the support is configured as two brackets, such that the plurality of longitudinally spaced slots are formed on the vertical brackets, such that each slot has an upper entry portion, and a lower retainer portion in order to connect the shelf to the support, the method comprising:

engaging the first and second transverse elements with adjacent upper entry portions for each bracket; and lowering the first and second transverse elements into adjacent lower retainer portions for each bracket.

16. The method of claim 13 wherein the support is configured as a unitary frame comprising at least one side wall, and the plurality of longitudinally spaced slots, each have an upper entry portion, and a lower retainer portion, the method comprising:

engaging the first and second transverse elements with adjacent upper entry portions of the at least one side wall; and lowering the first and second transverse elements into adjacent lower retainer portions of the at least one side wall, wherein the unitary frame is connected to a base for supporting the at least one side wall, and a header connected to the at least one side wall having an area for displaying indicia.

17. The method of claim 16 wherein the at least one side wall is a substantially U-shaped channel including an outer and an inner flange such that the plurality of longitudinally spaced slots are formed on the inner flange for engaging the first and second transverse elements in order to connect the shelf to the side wall, the method comprising:

engaging the first and second transverse elements into adjacent upper entry portions of the inner flange; and lowering the first and second transverse elements into adjacent lower retainer portions of the inner flange.

* * * * *